United States Patent [19]

Peck

[11] 4,164,183

[45] Aug. 14, 1979

[54] STENCILING APPARATUS HAVING IMPROVED CASING STRUCTURE

[76] Inventor: Gregory G. A. Peck, 165 Evergreen Dr., Gorham, Me. 04038

[21] Appl. No.: 834,708

[22] Filed: Sep. 19, 1977

Related U.S. Application Data

[63] Continuation-in-part of Ser. No. 629,650, Nov. 6, 1975, Pat. No. 4,048,918.

[51] Int. Cl.[2] ..... B41F 15/36

[52] U.S. Cl. ..... 101/114; 51/424; 101/127.1

[58] Field of Search ..... 101/127, 127.1, 128.1, 101/114; 51/424, 427, 436, 439, 310–312

[56] References Cited

U.S. PATENT DOCUMENTS

| | | | |
|---|---|---|---|
| 1,547,356 | 7/1925 | Berr | 101/128.1 X |
| 2,487,366 | 11/1949 | Penno | 51/410 X |
| 3,137,978 | 6/1964 | Incantalupo | 51/312 |
| 4,048,918 | 9/1977 | Peck | 101/127.1 X |

*Primary Examiner*—Clifford D. Crowder
*Attorney, Agent, or Firm*—William Nitkin

[57] ABSTRACT

A stenciling apparatus for the marking of identification indicia on vehicles and the like having a casing accommodating a housing incorporating the convergence of means for compressed air supply delivery means for stencil medium pickup and means for stencil medium delivery to the surface to be marked, the casing having an elongated front portion and a lower forward wall casing portion extending rearward at a downward incline and then curving abruptly downward and forward meeting a rear wall casing forming a cusp which acts as a stencil medium holding area and a substantially cubical stencil holding unit having at least one aperture for receipt of a stencil and an elongated v-shaped notch member upon the top surface of the stencil holding unit to mate and overlay a corresponding elongated v-shaped notch upon a top front surface of the stencil unit casing.

5 Claims, 11 Drawing Figures

STENCILING APPARATUS HAVING IMPROVED CASING STRUCTURE

This application is a continuation-in-part of application Ser. No. 629,650 filed Nov. 6, 1975 now U.S. Pat. No. 4,048,918 entitled "Stenciling Apparatus and Identification System".

BACKGROUND OF THE INVENTION

1. Field of the Invention

This invention relates to apparatuses used for stenciling selected indicia upon and into surfaces of structures for identification purposes and more particularly relates to apparatuses for stenciling numbers onto vehicle windows for purposes of anti-theft prevention such as found in U.S. Class 51, subclass 8.

2. Description of the Prior Art

Marking systems which etch by sandblasting or other means an identification indicia onto vehicle windows are now coming into widespread use in this country. In order to place identification indicia upon cars, stenciling apparatuses are utilized which direct a stream of sand or other abrasive stenciling medium through stencils against the vehicle's windows thereby permanently marking the glass. Code systems are utilized with central registries so that if an owner of a marked car needs to be identified, one can check the code number stenciled on the glass with such central registry to locate the owner of that vehicle. The advantages of stenciling identification indicia onto glass is that it takes a large expenditure of time, effort and money to obliterate or remove such indicia and usually car thieves do not wish to go through such expense and effort expecially if they must replace all the glass on a vehicle. These identification marks are usually placed on each window of the vehicle in an inconspicuous place.

Several problems, however, have arisen in the prior art regarding stenciling apparatuses. Many vehicles have windows that run at angles to the vertical and such stenciling apparatuses must work well in a vertical and horizontal position as well as all angles in between. Further the stenciling must be simple and easy to use with efficient stenciling medium recycling and must be designed so that the stencil will not become clogged at any time with stenciling medium.

SUMMARY

It is an object of this invention to disclose improvements to stenciling apparatuses in order to have a more efficient recycling of the stencil medium when the apparatus is used in horizontal positions as well as vertical positions and all positions in between. Further the stenciling apparatus as disclosed herein has an improved design of the stencil medium holding area to prevent stencil medium from falling forward and clogging the stencils when the stenciling apparatus is held in a horizontal position. It is a further object of the device of this invention to eliminate the necessity of having individual stencil pieces of different types which can be difficult to utilize by someone unfamiliar with the stencil construction and operation. It is further an object of this invention to have a stencil holding unit which is easy to properly affix to the stenciling apparatus and one in which the individual stencils are easily interchangeable.

DESCRIPTION OF THE PREFERRED EMBODIMENT

Figure 1:
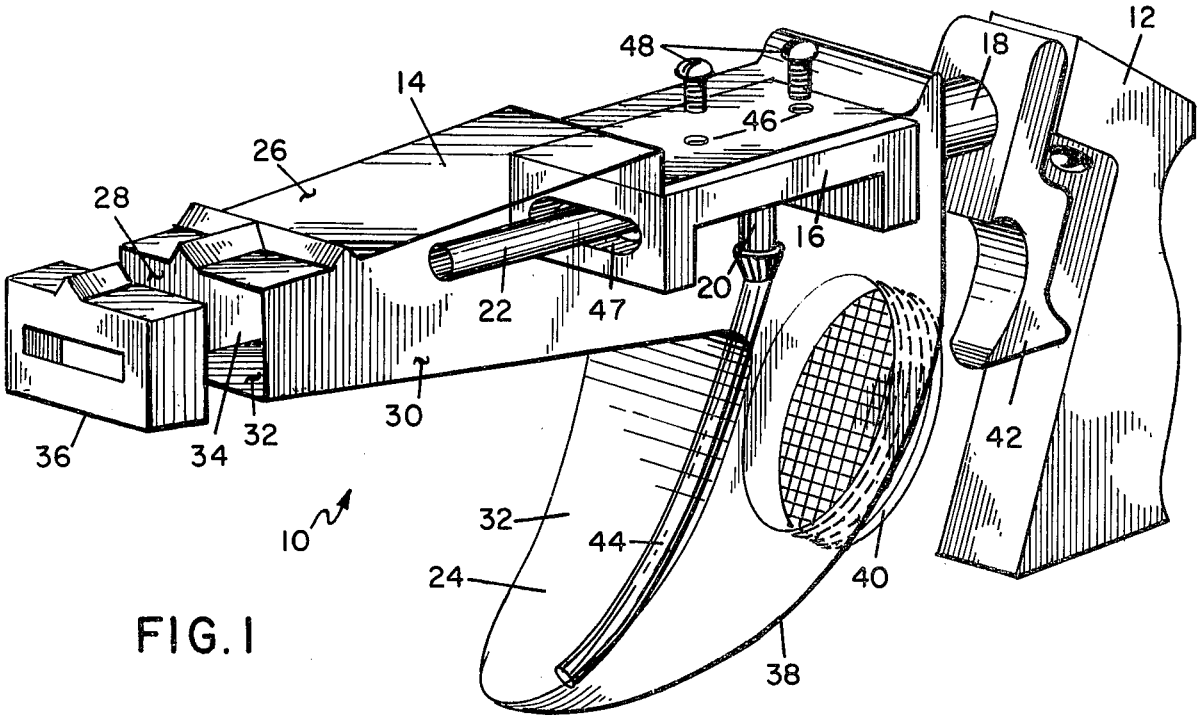
FIG. 1 illustrates a perspective view of the device of this invention with portions thereof in outline form to disclose interior structure.
Figure 2:
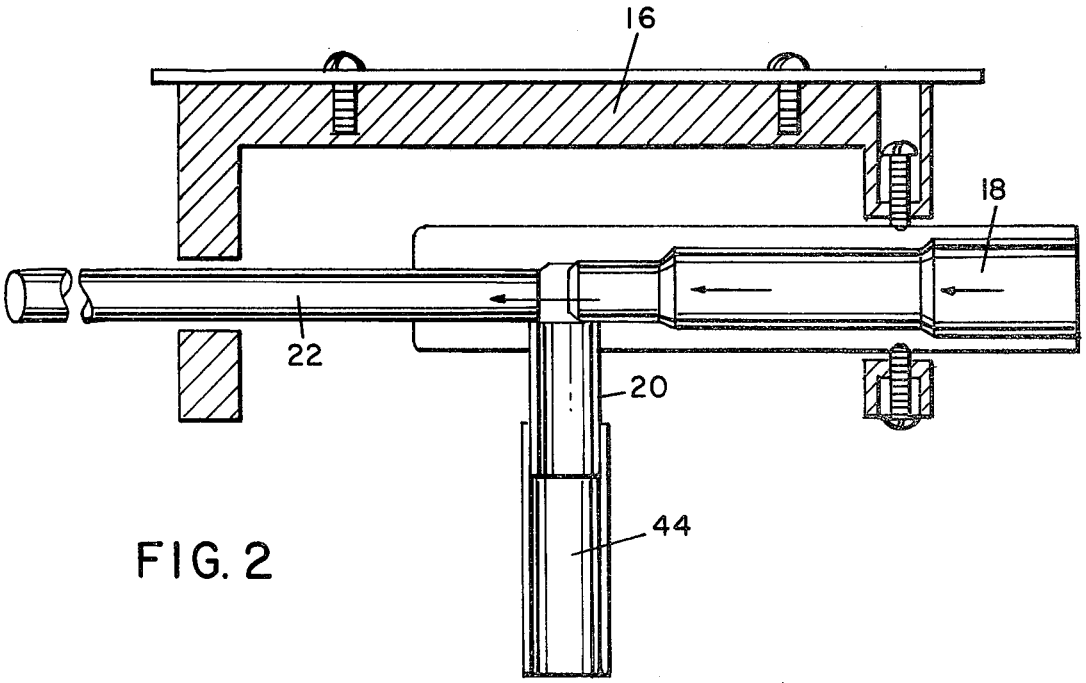
FIG. 2 illustrates a cross section of the stenciling apparatus mounting housing.

The stenciling apparatus is generally designated by reference numeral 10 in FIG. 1. Pistol-type compressed air supply delivery means 12 preferably is designed to be conveniently balanced with respect to stenciling apparatus 10 for easy handling and manipulation. Pistol-type compressed air supply means 12 is incorporated into the upper rear portion of casing body 14 where it enters housing 16 which encloses the convergence of compressed air supply pipe 18, abrasive stenciling medium pickup pipe 20, and stenciling medium delivery barrel 22. It will be noted, but for housing 16, casing 14 is hollow.

Of importance to the present invention is the design of casing body 14 due particularly to the shape and function of abrasive stenciling medium holding and recycling area, generally designated 24. Holding and recycling area 24 is formed by the lower extending portion of casing 14.

Casing 14 itself forms an enclosure having an upper surface 26 and side surfaces 28 and 30 which surround housing 16 which communicates with air supply means 12. Casing 14 extends forward to form, with a bottom surface 32, a substantially rectangular aperture 34. Stencil holding unit and retaining means 36 cover aperture 34 by being slidably engageably affixed to said four casing sidewalls forming the aperture. As best comprehended, these four casing sidewall surfaces may be situated in a somewhat tapered and converging relationship as the ends of the sidewalls and the aperture are approached.

Lower casing surface 32 forms the first portion of abrasive stenciling medium recycling and holding area 24. Lower surface 32 has increasingly greater slope the greater the distance from casing aperture 34. At a point approximating the forward portion of housing 16, lower surface 32 sharply curves downward and then curves forward at its lower extent. The conic shape of area 24 is similar to that of a parabolic spiral. Lower rear casing surface 38, extending from the lower portion of surface 32, curves upward to the rear of housing 16 from the cusp formed by the front and rear converging curved surfaces 32 and 38 to form what, when viewed cross-sectionally, would be a horn-like holding area. Incorporated within rear casing surface 38 is air pressure release means 40 which can be a screw-on filter or equivalent to allow air, but not stenciling medium, to escape from the unit.

As previously mentioned, pistol-type delivery means extends into the upper rear casing housing portion and is incorporated into housing 16. Trigger 42 or similar means may control the compressed air flow through air supply pipe 18 which controls the stenciling medium pick-up suction function. Stenciling medium pick-up pipe extension 44 extends into the lower portions of stencil medium recycling and holding area 24 to facilitate the suction pick-up of stencil medium to be delivered through barrel 22 and through aperture 34.

Figure 4:
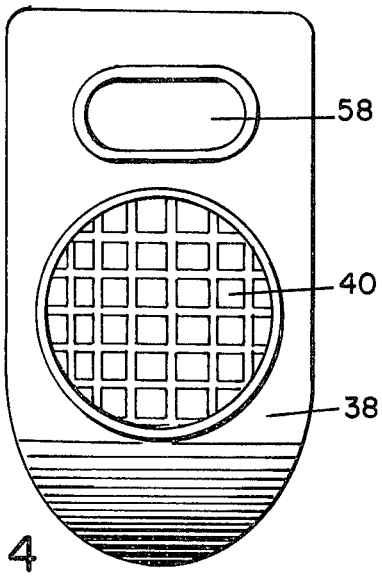
FIG. 4 illustrates a rear view of the stenciling apparatus casing.
Figure 5:
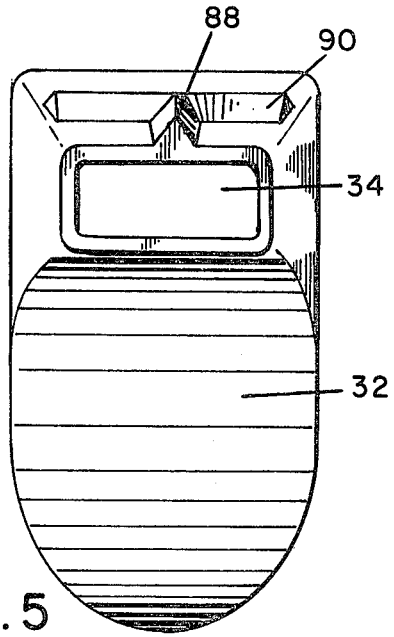
FIG. 5 illustrates a front view of the stenciling apparatus casing.

Housing 16 is affixed to casing 14 through apertures 46 in top surface 26 in a manner such that limited lateral movement of barrel 22 may occur. Barrel 22 thus has a range of lateral movement approximating the width of the barrel guide opening 47 such that the abrasive stream may be directed from side to side toward aperture 34. Barrel guide 47 also assists in preventing undesirable vertical movement of barrel 22. Bolts 48 facilitate the holding of housing 16 within the casing and facilitate removal of the gun assembly for necessary cleaning. It will be noted that aperture 58 as seen in FIG. 4 of rear casing surface 38 accommodates the entrance of pistol-type air supply member 12.

Figure 3:
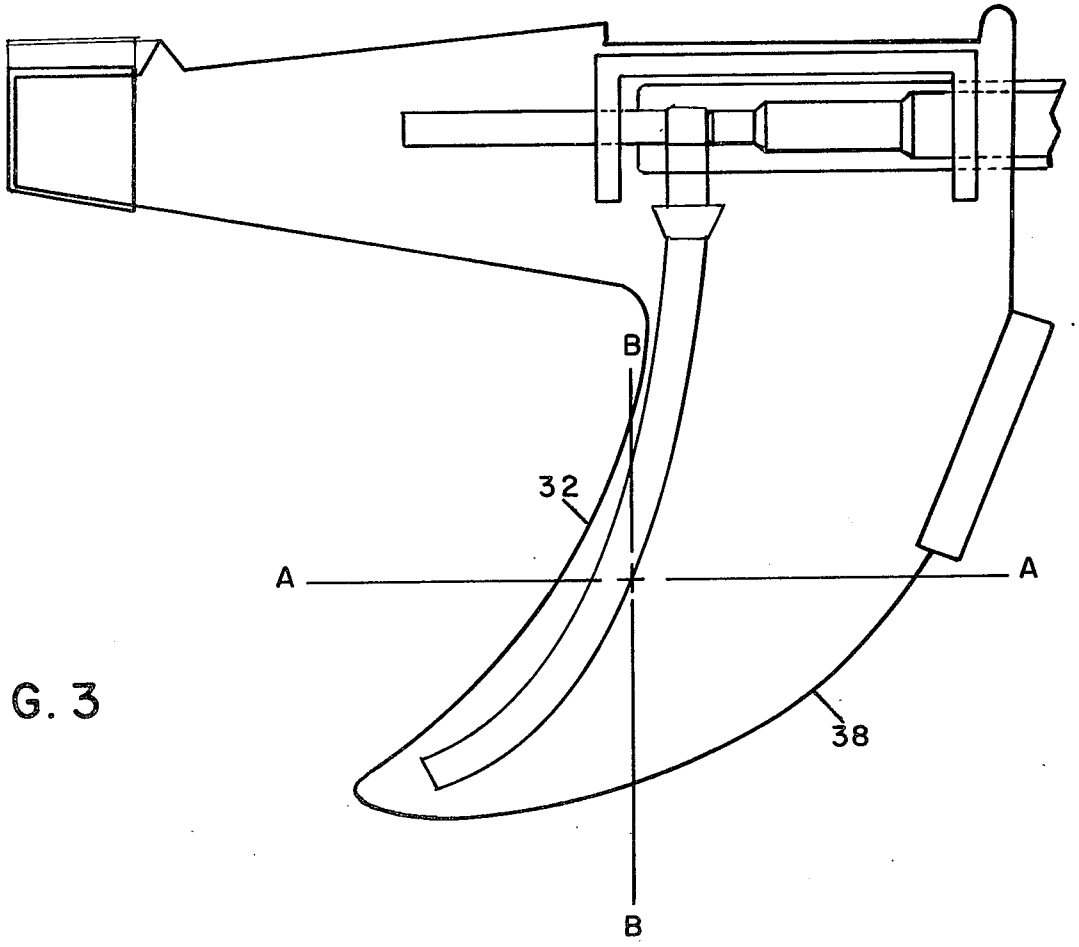
FIG. 3 illustrates a cross-sectional view through the stenciling apparatus casing.

Returning now to the abrasive stenciling medium recycling and holding area, it can be seen in FIG. 3 that the front and rear conic surfaces 32 and 38 along with side surfaces 28 and 30 retain the abrasive substance therebetween. It has been determined and therefore preferred that these surfaces contain an area below the base of air pressure release means defined by horizontal line A—A which substantially equals the area forward of line B—B which is tangential to casing wall 32 at the point where wall 32 begins to curve forward. This assures that little, if any, stenciling medium will fall forward from holding area 24 to aperture 34 and stencil holding unit 36 when the apparatus is used in an upright or vertical position. Air pressure directed at stencil holding unit 36 in combination with air pressure release means 40 helps to recycle stenciling medium when used in positions other than horizontal. It is important that when the apparatus is used vertically that substantially all stenciling medium return to the holding area quickly. Such is accomplished by means of the curved surface 32 of holding area with the cusped bottom.

Figure 6:
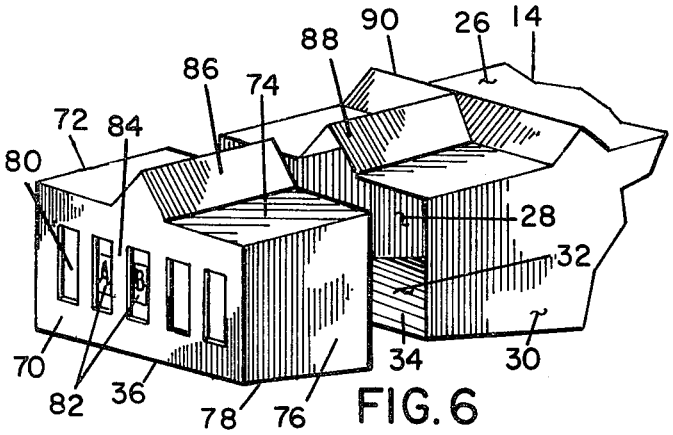
FIG. 6 illustrates the stencil holder separated from the front of the stencil casing.
Figure 7:
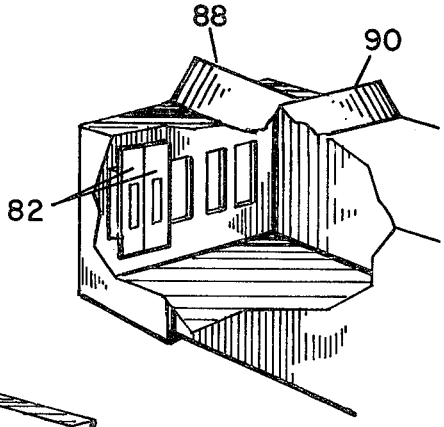
FIG. 7 illustrates an interior view through a portion of the stencil casing disclosing the stencils in place within the stencil holder.
Figure 8:
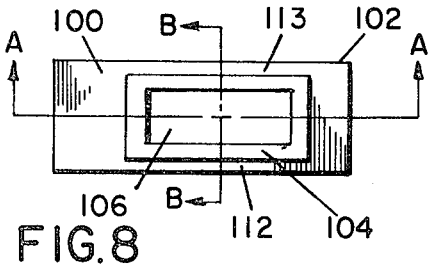
FIG. 8 illustrates a top view of a stencil.
Figure 9:
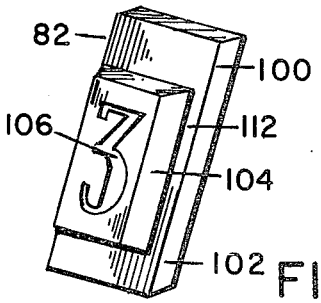
FIG. 9 illustrates a perspective view of a stencil.

With reference now to FIGS. 6 and 7, the embodiment of the stencil holding unit 36 is illustrated and described. Stencil holding unit 36 is a substantially cubic enclosure having a front surface 70 and four adjacent side surfaces 72, 74, 76 and 78. Stencil holding unit 36 is slideable over and engageable with the aforementioned forward sidewalls 26, 28, 30 and 32 of casing 14 which form aperture 34. Any incline of these casing sidewalls will be matched by stencil holding unit 36. The front surface of stencil holding unit 36 has at least one aperture 80. Where there is a plurality of stencils 82 to be utilized, spaced vertical dividers 84 are utilized.

Stencil holding unit 36 has upon its upper surface a hollow v-shaped notch 86 which slideably engages a slightly smaller notch 88 upon casing upper surface 26. When stencil holding unit 36 is slipped over the casing end, stencil unit v-shaped notch 86 slips over casing notch 88 so that the stencil holding unit cannot be inserted upside down. Notch 90 prevents the stencil holding unit from being inserted too far on casing 14. The stencil holding unit should be somewhat resilient so that a close and tight fit may be obtained through this engagement system.

Figure 10:
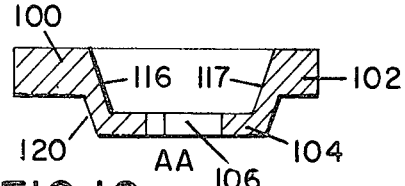
FIG. 10 illustrates a cross-sectional view through A—A of FIG. 8.
Figure 11:
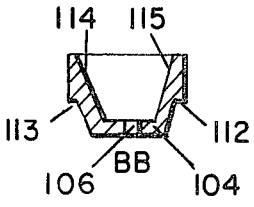
FIG. 11 illustrates a cross-sectional view through B—B of FIG. 8.

FIGS. 8–11 illustrate the type of stencil preferably utilized with the present invention. Stencil 82, made of a somewhat resilient material, has two opposing end portions 100 and 102 and a middle portion 104 which is raised out of the plane of the end portions and has indicia aperture 106. Displacement 120 of middle portion 104 from end portions 100 and 102 as shown in FIG. 10 is approximately the thickness of the front of the stencil holding unit, thus the front surface of stencil holding unit 36 would be planar when the stencils are inserted. The individual stencils are merely snapped into position within apertures 80 between dividers 84 inside stencil holding unit 36 as seen in FIG. 7. The stencils should be of a width so as to be in close contact with dividers 84. Lips 112 and 113 are positioned longitudinally upon the sides of the stencils which make contact with dividers 84 to prevent any leakage of stenciling medium directed thereon.

Although the present invention has been described with reference to particular embodiments, it will be apparent to those skilled in the art that variations and modifications can be substituted therefor without departing from the principles and spirit of the invention.

I claim:

1. An improved casing for a stenciling apparatus of the type containing a stenciling medium therein to be delivered by means of a compressed air stream to a surface to be marked having the upper rear portion of the casing adapted to accommodate therein a housing incorporating the convergence of means for compressed air supply delivery, means for stencil medium pickup and means for stencil medium delivery to said surface, said casing having a forward portion formed by an upper surface sidewall, a bottom surface sidewall and a pair of sidewalls all forming at said forward portion a substantially rectangular aperture aligned to oppose said rear portion of said casing and the stenciling medium delivery means wherein the improvement comprises:

said bottom surface sidewall extending from said rectangular aperture rearward at an incline and at a position below said housing curving abruptly downward and then forward at its lower extent;

a lower rear sidewall extending from the upper rear portion of said casing downward in a forwardly bowed curve meeting said bottom surface sidewall; and said pair of surface sidewalls extending downward meeting said bottom surface sidewall and said lower surface sidewall forming an improved stenciling medium recycling and holding area in the shape of a forwardly extending cusp in order to better retain said stenciling medium in said holding and recycling area when the stenciling apparatus is used in a vertical position.

2. The stenciling apparatus casing of claim 1 having means to affix stencils over said frontal casing aperture.

3. The stenciling apparatus of claim 2 wherein the means of affixing said stencils comprises:

a stencil holding unit having at least one substantially rectangular aperture defined within its front surface and four perpendicularly abutting sides to mate with said forward portion of said casing in an overlying relationship;

a casing v-shaped notch member upon the upper sidewall surface of said casing; and a v-shaped notch upon the upper of said sides of said stencil holding unit to mate and overlay said casing v-shaped notch.

4. The apparatus as recited in claim 3 further including at least one stencil member to be removably affixed within said frontal aperture of said stencil holding unit; and wherein said stencil comprises a substantially rectangular member having two end portions in the same plane and a middle portion raised out of the plane of said end portions and having an indicia aperture therethrough.

5. The apparatus as recited in claim 4 wherein said housing is affixed within said casing to allow limited pivotal lateral movement of said stenciling medium delivery means to direct said medium horizontally across said stencils.

* * * * *